United States Patent [19]

Bedi et al.

[11] Patent Number: 4,976,233

[45] Date of Patent: Dec. 11, 1990

[54] QUICK CONNECT COUPLING ADAPTERS FOR FACILITATING SIMPLE AND HIGH SPEED OIL CHANGE IN AN INTERNAL COMBUSTION ENGINE

[75] Inventors: Ram D. Bedi; Andrianus J. van der Griendt, both of Birmingham, Mich.

[73] Assignee: K.J. Manufacturing, Wixom, Mich.

[21] Appl. No.: 490,082

[22] Filed: Mar. 7, 1990

Related U.S. Application Data

[63] Continuation-in-part of Ser. No. 413,008, Sep. 26, 1989, and a continuation-in-part of Ser. No. 350,303, May 11, 1989, Pat. No. 4,884,660.

[51] Int. Cl.[5] ..... F01M 1/00

[52] U.S. Cl. ..... 123/196 R; 184/1.5; 184/105.3

[58] Field of Search ..... 123/196 R; 184/1.5, 184/105.3

[56] References Cited

U.S. PATENT DOCUMENTS

| | | | |
|---|---|---|---|
| 2,249,303 | 7/1941 | Smith | 184/1.5 |
| 2,554,389 | 5/1951 | Stevens | 184/1.5 |
| 2,594,779 | 4/1952 | Huffman | 184/1.5 |
| 3,720,287 | 3/1973 | Martel | 184/105.1 |
| 4,095,673 | 6/1978 | Takeuchi | 184/1.5 |
| 4,101,000 | 7/1978 | Scully | 184/1.5 |
| 4,151,823 | 5/1979 | Grosse et al. | 123/196 A |
| 4,269,237 | 5/1981 | Berger | 184/1.5 |
| 4,709,722 | 12/1987 | Knapp | 184/1.5 |
| 4,745,894 | 5/1988 | Laipply | 184/1.5 |
| 4,756,349 | 7/1988 | Atkins | 184/1.5 |
| 4,776,430 | 10/1988 | Rule | 184/1.5 |
| 4,865,156 | 9/1989 | Poliny | 123/196 R |
| 4,883,102 | 11/1989 | Gabrielyan et al. | 184/1.5 |
| 4,884,660 | 12/1989 | Bedi | 184/1.5 |

OTHER PUBLICATIONS

Valvoline's Progressive Oil Sample Testing Program; publication date unknown but at least as early as 5-8-89.

Auto.Matic Oil Changer advertisement, Carol Wright Gifts, ©1990.

Fluid Evacuators Promotional Literature, publication date unknown.

National Petroleum News-Sep. 1989 (reprinted from 5-88), Why Quick Lube Outlets Are Grabbing Market Share, by M. Edmond.

NY Fast Lube is Industry Innovator, National Oil & Lube News-Nov. 1989.

European Evacuation Method Enters U.S.A., by S. Bernhard, National Oil & Lube News-Nov. 1989.

*Primary Examiner*—E. Rollins Cross

*Attorney, Agent, or Firm*—Basile and Hanlon

[57] ABSTRACT

Quick connect coupling adapters for facilitating simplified rapid oil change in an associated internal combustion engine, including a drain opening adapter having an integral body with a central throughbore and a branch throughbore angularly oriented thereto. The adapter includes appropriate means for attaching an end of the branch throughbore to the drain plug opening and means for sealingly attaching the drain plug to one end of the central throughbore. An oil conveying hose is attached to the other end of the central throughbore. The oil conveying hose includes a quick connect coupling releasably attachable to an external pump device. An additional oil fill adapter is positionable in a suitable engine opening such as the dipstick tube or oil fill opening in the valve cover. The oil fill adapter includes a central oil conveying body having an inlet and an outlet means for attaching the outlet in the engine opening, and a fill hose attached to the inlet. The fill hose includes a suitable quick connect coupling member releasably attachable to a fill point on an external pump device.

26 Claims, 4 Drawing Sheets

QUICK CONNECT COUPLING ADAPTERS FOR FACILITATING SIMPLE AND HIGH SPEED OIL CHANGE IN AN INTERNAL COMBUSTION ENGINE

CROSS-REFERENCE TO RELATED APPLICATIONS

This application is a continuation-in-part of Ser. No. 07/413,008 filed on Sept. 26, 1989 and Ser. No. 350,303 filed on May 11, 1989, now U.S. Pat. No. 4,884,660 which are currently pending before the United States Patent Office.

BACKGROUND OF THE INVENTION

1. Field of the Invention

This invention relates to a method and device for changing motor oil. Such internal combustion engines can be found on automobiles, trucks, tractors, heavy earth moving equipment, military equipment, or the like. More particularly, this invention relates to processes in which residual spent oil is expediently removed. Finally, this invention relates to adapters which can be attached to existing engine openings to facilitate this method.

2. Background of the Relevant Art

The benefits of routine oil changes in a vehicle are well known. Routine oil changes have been shown to increase engine life and performance. With repeated prolonged use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine performance and if left unchanged can destroy or cripple the engine performance. It is recommended by at least one oil manufacturer that the level of total solid concentration be limited to levels below 3.0% with levels of silica being present in amounts lower than 25 parts per million and sodium in amounts lower than 200 parts per million.

To obtain satisfactory automotive engine performance, and maintain solids concentration levels in the motor oil lower than the recommended 3.0%, changing the motor oil in an automotive engine is a necessary, but an undesirable, dirty and time-consuming task. In currently designed vehicles, the oil pan serves the purpose of a reservoir for circulation of engine oil. Engine lubrication is generally accomplished through a gear-type pump. The pump picks up engine oil from the oil pan sump, where oil is drawn up through the pick-up screen and tube, and passed through the pump to the oil filter. The oil filter is generally a full flow paper element unit. In some vehicles, an oil filter bypass is used to insure adequate oil supply, should the filter become plugged or develop excessive pressure drop. Oil is routed from the filter to the main oil gallery. The gallery supplies valve train components with oil, and by means of intersecting passages, supplies oil to the cam shaft bearings. Oil draining back from the rocker arms is directed, by cast dams in the crank case casting, to supply the cam shaft lobes. Oil also drains past specific hydraulic lifter flats to oil cam shaft lobes directly. The passages supplying oil to the cam shaft bearings also supply the crank shaft main bearings through intersecting passages. Oil from the crank shaft main bearings is supplied to the connecting rod bearings by means of intersecting passages in the crank shaft. The front cam bearing can include a slot on its outside diameter to supply oil to the cam sprocket thrust face. In some engines, many internal engine parts have no direct oil feed and are supplied either by gravity or splash from other direct feed components. A bypass valve can also be disposed in the oil pick-up screen to insure adequate oil flow if the screen should become restricted. A pressure regulator valve, sometimes located in the oil pump body, maintains adequate pressure for the lubrication system and bypasses any excess back to the suction side of the pump. Oil from the pump passes through the filter before going to the engine oil galleries. In the filter, the oil passes through a filtering element where dirt and foreign particles are removed.

To remove the contaminated oil, the drain plug, generally located in the lowermost region of the oil pan, is opened. The spent oil containing suspended particles is permitted to flow under gravity out of the pan into a suitable receptacle. After the spent oil is removed, the plug is replaced and fresh oil is added to the engine usually through a separate opening in the engine valve cover. The process of gravity drainage does not remove all of the spent oil with its metallic and non metallic particulates which stick to the oil pan container walls, as well as engine components such as the crank shaft, connecting rods, pistons and the like which are exposed to the motor oil spray lubrication. These particles remain to be mixed with fresh motor oil. Thus the concentration of contaminants is lowered by dilution and only a part of the total contaminates are actually eliminated.

The oil change process is essentially the same whether performed at home, at service stations or at one of the various oil change centers which have opened in recent years. The flow rate, or time required for oil drainage, is the same for each of these locations, because it is limited by the size of the drain plug aperture and the force of gravity. Service stations and other locations simplify the process of oil drainage with the use of hydraulic racks, special oil collection receptacles and the like. However, this specialized and expensive equipment is not readily available to the typical automotive owner who may wish to change the oil in his vehicle at home. It has been estimated that the retail market of oil is approximately 2.83 billion quarts or approximately 700 million gallons. The do-it-yourself individual has been found to be price sensitive, and tends to distrust the quality of service stations and other oil change centers. The do-it-yourself individual typically believes that if you want a job done right, you do it yourself. However, the current design of vehicles does not lend itself to do-it-yourself oil changes in a convenient clean and effortless manner. Many vehicles have low ground clearance making it difficult to access the oil drain plug for removal of the spent oil, and also making it difficult to collect the oil without contaminating the surrounding environment.

Environmental protection is a prominent social issue in our present society. Therefore, it would be desirable to encourage do-it-yourself oil changers to perform this type of task in an environmentally safe manner. It is estimated that there are approximately 119 million privately owned passenger vehicles. These vehicles require approximately 360 million oil changes a year, using an average of 1.2 gallons per change based on an average oil change frequency of 2.94 times a year. This amounts to approximately 550 million gallons of motor oil a year. Of this amount, it is estimated that 70% of motor oil is installed by motorists themselves. It is believed that pursuant to present practice, the spent oil drained by motorists finds its way into spent household containers, such as milk cartons. The household containers are closed and disposed of in the garbage which can and will finally find its way into the local waste dump. As the household container deteriorates, the oil and its contaminates will eventually seep into the surrounding ground water below the dump site. It has been estimated that 6.6 million barrels of oil a year seeps into U.S. soil creating serious potential ground water pollution problems. It would be desirable environmentally and economically if this oil could be collected and recycled. In order to motivate the do-it-yourself market, it is desirable in the present invention to make the collection of oil during oil changes effortless, clean and inexpensive.

Conservation of energy and the trade deficit are also major issues in today's society. It is estimated that 250–360 million gallons of spent oil can now be easily collected and profitably recycled. The price of spent oil so collected is four dollars per barrel at best, while the price of crude oil is much greater at approximately $18.00 per barrel. Recycling easily collected spent oil could decrease the trade deficit by approximately 120 million dollars, while providing a profitable recycling economy of approximately 86 million dollars per year.

Thus, it is desirable to provide means for accomplishing a rapid, clean oil change. It would also be desirable to provide a process which accelerates removal of spent oil, associated contaminants, and degraded oil additives to permit eventual replacement with fresh engine oil in a unified process at one single location in an associated vehicle. It is also desirable to provide a method and device by which an independent oil change can be accomplished which also eliminates the opportunity for oil handling and exposure. It is desirable to provide a process which could easily be employed successfully by the vehicle owner with all of the benefits associated with the method of the present invention; i.e. time saving, convenience, no spills, and, finally, longer lasting engines. It is also desirable to provide a method and apparatus which utilizes an air purging device which can eliminate any residual oil in the associated lines to eliminate opportunities for oil contamination and spillage. Finally, it is desirable to provide adapters which can be easily inserted into existing openings to facilitate rapid oil change.

SUMMARY OF THE INVENTION

The present invention is a process and apparatus for high speed oil change in an internal combustion engine having a crank case and an oil pan. The apparatus includes adapters insertable in selected existing engine openings to facilitate oil change.

The device of the present invention includes an oil fill adapter which can be fitted onto a suitable opening in fluid communication with the oil pan. Examples of suitable openings include as the dipstick tube or the oil filler cap opening in the valve cover. The oil fill adapter includes means for sealingly, and releasably attaching the adapter to the associated opening and a filler opening in fluid communication with a quick connect coupling member. The quick connect pressure coupling member can be attached to a suitable oil fill line with a mating quick connect coupling member which is in fluid communication with a source of fresh oil.

The device also includes a drain plug adapter which can be sealingly attached to an opening in fluid communication with the oil pan such as the drain plug opening in the oil pan. The drain plug adapter also includes or is in communication with a quick connect coupling member in fluid communication with the drain plug adapter. The quick connect coupling member associated with the drain plug adapter can be releasably attached to a suitable oil pump-out line.

In the method of the present invention, a rapid efficient oil change can be performed using the adapter devices of the present invention by connecting the respective quick connect members to mating members on a suitable external pump device. Once connected, a removal force can be exerted through the drain plug adapter to remove spent oil collected in the oil pan. Once the spent oil is removed, the old oil filter can be replaced with a new filter, if desired. An appropriate amount of fresh motor oil can then be introduced into the crankcase through the respective oil filler adapter. The introduction force is sufficient to achieve the rapid addition of fresh oil to the engine environment and to permit contact between the fresh oil and the moveable engine components. The amount of fresh lube oil introduced is that which is appropriate for the respective engine. After the fresh oil has been introduced, the external pump device coupling members can be removed and normal engine operation can commence.

When desired an air purging mechanism optionally included on an external pump device can be utilized to accomplish optional air purging steps to remove residual oil which may remain in the filling and emptying lines as a result of oil filling and removal.

BRIEF DESCRIPTION OF THE DRAWING

In the present description, reference is made to the following drawings in which like reference numerals are used to refer to like elements throughout the various views and in which.

DESCRIPTION OF THE PREFERRED EMBODIMENT

The basic process of the present invention can be employed successfully with internal combustion engines which have oil pans or similar oil reservoirs.

THE APPARATUS

The device of the present invention consists of an oil filler adapter and a drain plug adapter which facilitate rapid addition and removal of oil to and from the engine to which they are connected. It is to be understood that the oil filler adapter may be sealingly attached to a suitable engine opening or openings temporarily or permanently and that, while these fill adapters can be used independently, or in combination with one another on any given engine, only one adapter need be employed with the engine to be considered within the purview of this invention.

Figure 3:
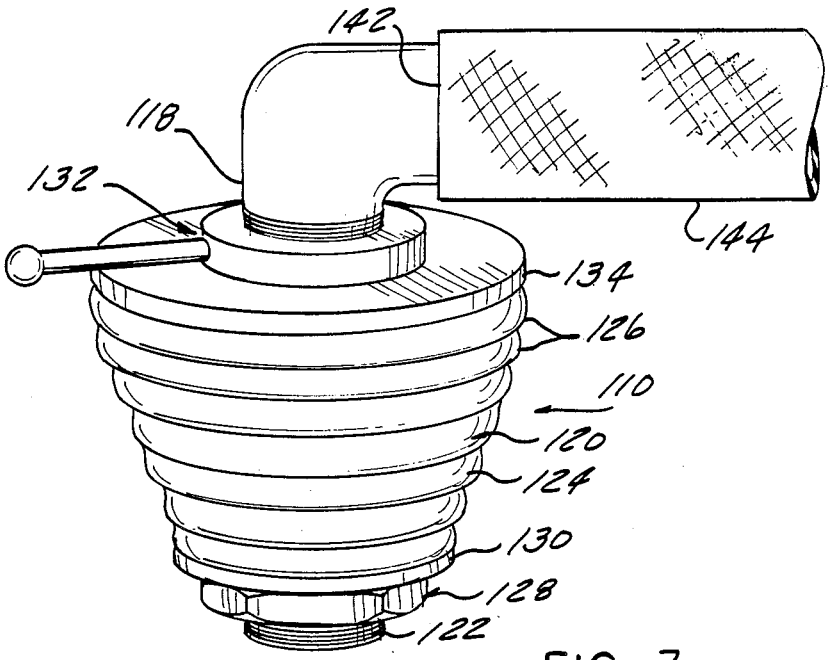
FIG. 3 is a perspective view of a second embodiment of the oil fill adapter of the present invention.
Figure 4:
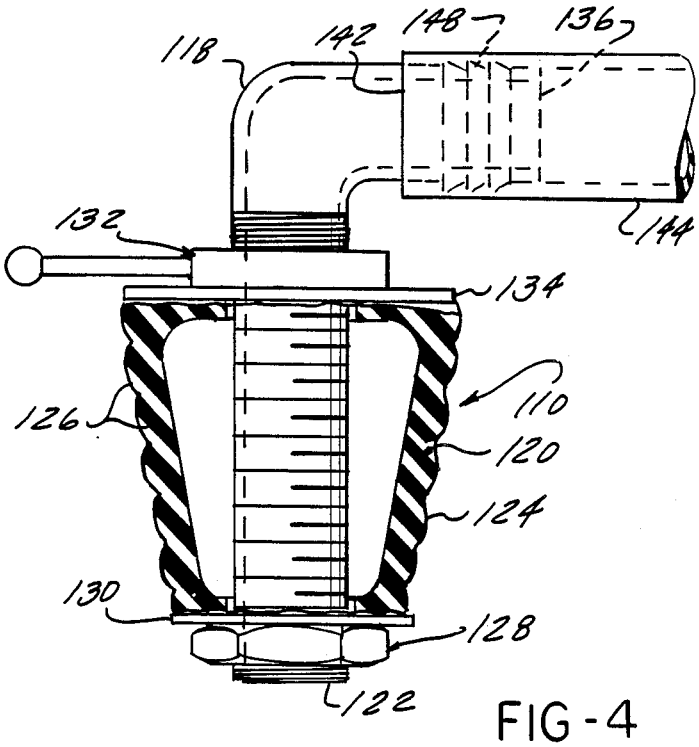
FIG. 4 is a partial cross-sectional view of the oil fill adapter of FIG. 3.
Figure 5:
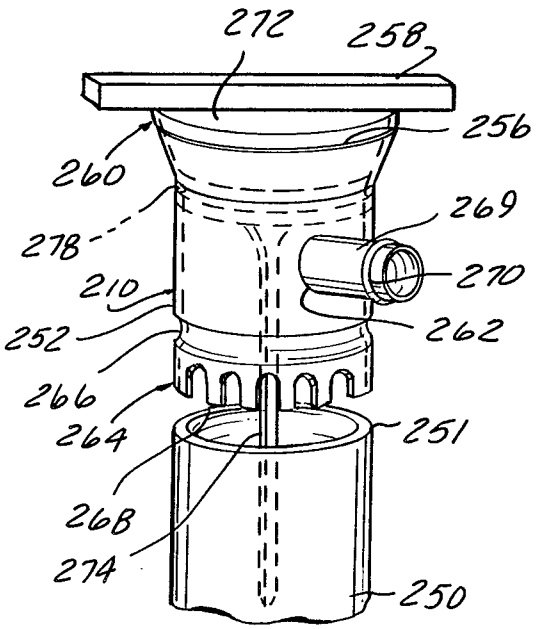
FIG. 5 is a perspective view of the third embodiment of the oil fill adapter of the present invention.

The oil fill adapter of the present invention may be removably attached to either the oil fill opening in the engine valve cover 12 as shown in FIGS. 1, 2, 3 and 4 or in the dipstick tube 14 as shown in FIG. 5. The oil fill adapters generally include means for sealingly attaching the oil fill adapter to the respective engine opening, means for connecting a suitable filling hose to the adapter and a suitable passage for conveying fresh oil into the crankcase.

Figure 1:
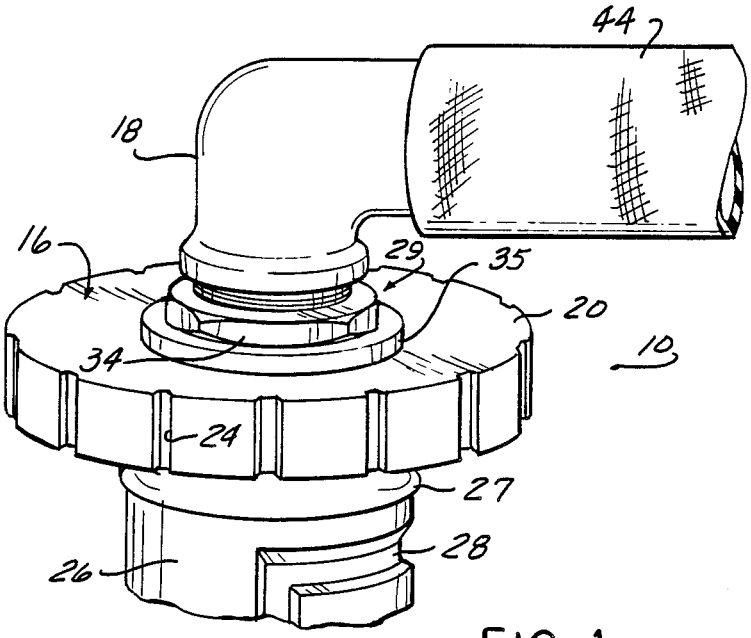
FIG. 1 is a perspective view of the first embodiment of the oil fill adapter of the present invention with an intermediate fill hose attached thereto.
Figure 2:
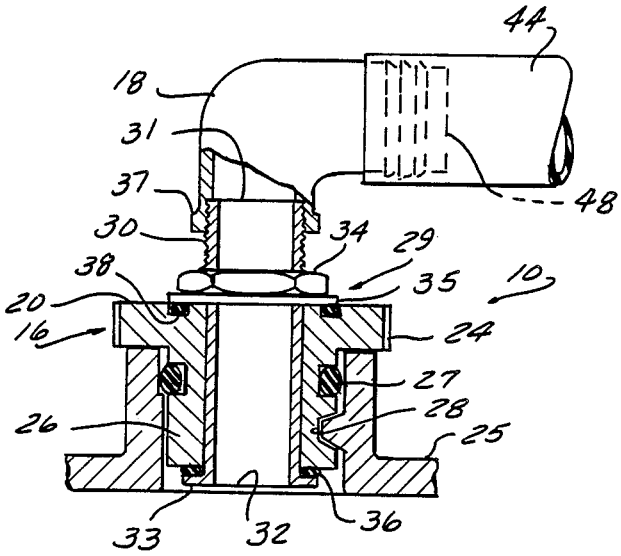
FIG. 2 is a partial cross-sectional view of the oil fill adapter of FIG. 1.

In the first embodiment as shown in FIGS. 1 and 2, the oil fill adapter 10 of the present invention is adapted to be threadingly inserted in the oil fill opening in the engine valve cover. This oil fill adapter may be used to replace the conventional oil fill opening cover. The oil fill adapter 10 of the first embodiment is composed of an oil filler cap portion 16 and a connector 18.

The oil filler cap portion 16 includes an overlying lid 20 with optional exterior laterally oriented gripping ridges 24. The lid 20 has a diameter larger than that of the oil fill opening in the engine valve cover and is adapted to overlie and be matingly inserted in the oil fill opening located on the engine valve cover 25. The cap portion 16 of the oil fill adapter 10 also includes an insert sleeve 26 adapted to be matingly insertable within the valve cover opening. The insert sleeve 26 preferably includes a sealing means 27. The sealing means 27 is, preferably, an O-ring. The sleeve 26 also has a suitable fastening means 28 to maintain the oil fill adapter 10 in position in the associated valve cover opening. The fastening means 28 is preferably a threaded surface adapted to matingly connect with a mating surface on the interior of the oil fill opening in the engine valve cover 25.

The connector 18 is attached to the screw lid 20 in a suitable manner to provide fluid communication therethrough by suitable attachment means. In the preferred version of this embodiment, the connector 18 is free to rotate relative to the lid 20 by means of a leak-tight swivel connection means 29. One such example of a suitable swivel means 29 is shown in FIG. 2. This swivel means 29 includes a central shaft 30 adapted to be rotatably positioned in an aperture in the lid. The central shaft 30 has a first end 31 matingly received in the connector 18 and a second oil fill opening end 32 opposed to the first end 31 and located inside the oil fill opening when the oil fill adapter 10 is in position therein. An annular flange 33 is located at the oil fill opening end 32 of the central shaft 30.

In the embodiment shown in FIG. 2, a washer 35 is positioned on the exterior of the central shaft 30 at a central position which, in combination with the annular flange 33 and nut 34, holds the connector in fixed lateral position relative to the lid 20. Interpositioned between the lid 20 and the washer 33, is a sealing gasket 38. Interposed between the annular flange 33 and the lowermost surface of insert sleeve 26 is a washer 36. The connector 18 as shown in FIGS. 1 and 2 is an angular conduit having a first end 37 connected to the central shaft 30 and a second end connected to a suitable fill hose 44 by a self-sealing, push-on hose connector 48, as is known and commercially available in the hose connection art.

The second embodiment of the oil fill apparatus shown in FIGS. 3 and 4 is configured to work as a universal valve cover oil fill adaptor 110 which can be removably positioned in a variety of valve cover openings of differing diameters. This embodiment of the valve cover adapter typically does not function as an oil filler cap replacement rather when oil change or replenishment is desired, the conventional oil filler cap (not shown) can be removed and the universal valve cover oil fill adapter 110 inserted into the opening.

The oil fill adapter 110 of the second embodiment of the present invention includes a connector 118 which is preferably an angular hollow conduit such as that described previously in conjunction with FIGS. 1 and 2. The connector 118 has a first oil filling end 122 adapted to extend inwardly in the valve cover opening. The connector 118 is movably connected with a plug member 120 having a central aperture through which the connector 118 extends.

The plug member 120 includes a sealing member which can be placed in sealing contact with the valve cover opening. The plug member 120, preferably, has a pair of opposed parallel faces through which connector 118 perpendicularly extends. Between the opposed faces is a tapered outer surface region 124 which, preferably has a series of contours such as ridges 126 which aid in establishing sealing contact between the plug member 120 and the surfaces surrounding the valve cover opening. The plug member 120 has a hollow interior central cavity defined by the interior of the opposed faces and interior of the tapered outer surface region 124. The plug member 120 is constructed from a material having sufficient deformability that compression of the opposing faces of the plug member 120 will result in an outward deflection of the surface of the tapered region 124. The plug member 120 is held in position relative to the connector 118 by a suitable retaining means 128 located on the connector 118 adjacent to the first oil filler end 122. The retaining means 128 may be a suitable nut or annularly extending flange connected to the connector 118. The plug member 120 is oriented such that the smaller opposing face is positioned in close proximity or abutting relationship with retaining means 128. As shown in FIG. 4, a first washer 130 is interposed between the retaining means 128 and the smaller opposing face. A releasable tightening means 132 is connected to the connector 118 to compress the plug member 120 and expand tapered sides 124. The tightening means 132 can be a suitably machined round nut with a locking lever. Interposed between the tightening means 132 and the larger opposed face of the plug member 120 is a second washer 134. The second end 136 of connector 118 (shown in phantom in FIG. 4) is insertable within the terminal end 142 of fill hose 144. The fill hose 144 and connector 118 are connected by a suitable leak-tight connecting means, such as self-sealing, push-on type hose connector 148, as is known and commercially available in the hose connecting art.

In the third embodiment the oil fill adapter 210 as shown in FIG. 5, the present invention is adapted to be attached to the dipstick tube 250 of the associated engine. The oil fill adapter 210 has a central body 252 having a first outlet 254 adapted to fit matingly with the terminal end 251 of dipstick tube 250 and a second opposed outlet 256 adapted to receive the engine dipstick 258 and a suitable dipstick sealing means 260. The central body 252 also has a centrally located hose connection inlet port 262.

The first outlet 254 of the central body 252 is equipped with an attaching means 264 and a retention collar 266. When attached to the dipstick tube 250, the terminal end 251 abuts the inner surface of retention collar 266. The attaching means 264 is preferably a series of fluted extensions 268 extending outward and downward from the retention collar 266 adapted to overlie the area of the dipstick tube 250 adjacent to the terminal end 251. In the preferred embodiment, the attaching means 264 also includes a suitable clamp (not shown) adapted to encircle the fluted extensions 268 to clampingly contact them in position against the outer surface of the dipstick tube 250. The retention collar 266 is, preferably, an interiorly projecting annular ring interposed between the attaching means 264 and the centrally located hose connection port 262. In order to facilitate a sealing connection between the terminal end 251 of dipstick tube 250 and the oil fill adapter 210, the retention collar 266 can include a suitable gasket or compressible member (not shown).

The centrally located hose connection inlet port 262 is, preferably, a hollow member 269 projecting angularly outward from the central body 252. A suitable fill hose (not shown) is attached to the hollow member 269 by any suitable attachment means. In FIG. 5, the angularly projecting hollow member has an annular flange 270 positioned on its outer surface. The terminal end of an appropriate fill hose can overlay the flange 270 and be maintained in position by an appropriate fastening means (not shown).

The hollow member 269 has a central passage in fluid communication with a central interior passage defined by the central body 252 of oil fill adapter 210. The hollow member 269 may project outwardly from the central body 252 at any desired angular orientation. In the embodiment shown in FIG. 5, the hollow member 269 extends perpendicularly from the central body 252 relative to its longitudinal axis. The diameter of the central interior passage defined by the central body 252 is essentially equal to that defined by the interior of the dipstick tube 250.

The dipstick sealing means 260 is preferably a plug 272 sealingly positionable in the second outlet 256 to prevent egress of fluid introduced through the centrally located hose connection port 262 through the second outlet 256. The plug 272 is permanently and sealingly positioned coaxially around the indicator blade 274 of dipstick 258 permitting longitudinal passage of the indicator blade 274 of dipstick 258 through the central body 252 of oil filler apparatus 210 and into the dipstick tube 250.

The dipstick 258 and the plug 272 are manually removable from the second outlet 256 as a single element. When a vehicle operator wishes to check the engine oil level in his or her vehicle, the dipstick 258 and accompanying plug 272 can be removed from the second outlet 256 to give a visual indication of engine oil level. In order to give an accurate oil level indication, it is to be understood that the indicator blade 274 of the dipstick 258 may be elongated to include the added height of the oil fill apparatus 210 of the present invention, or in the alternative, the dipstick tube 250 may be shortened by an appropriate amount prior to the installation of the oil fill adapter 210 so that the length of the indicator blade 274 of the dipstick 258 does not require alteration. In order to provide a sufficient sealing fit between the plug 272 and the central body 252 of the present invention, the sealing means 260 may also include suitable sealing members incorporated in the central body 252 such as an annular sealing ring 278 disposed in the interior of the central body 252.

Figure 6:
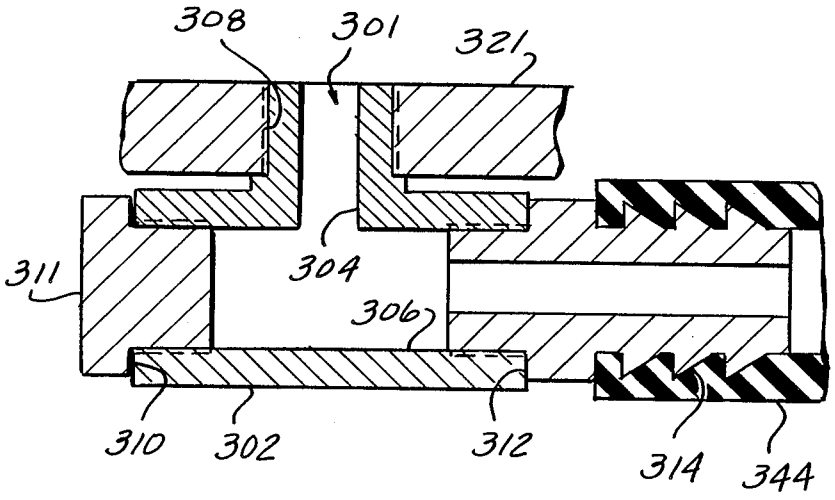
FIG. 6 is a cross-sectional representation of the drain plug adapter of the present invention.
Figure 7:
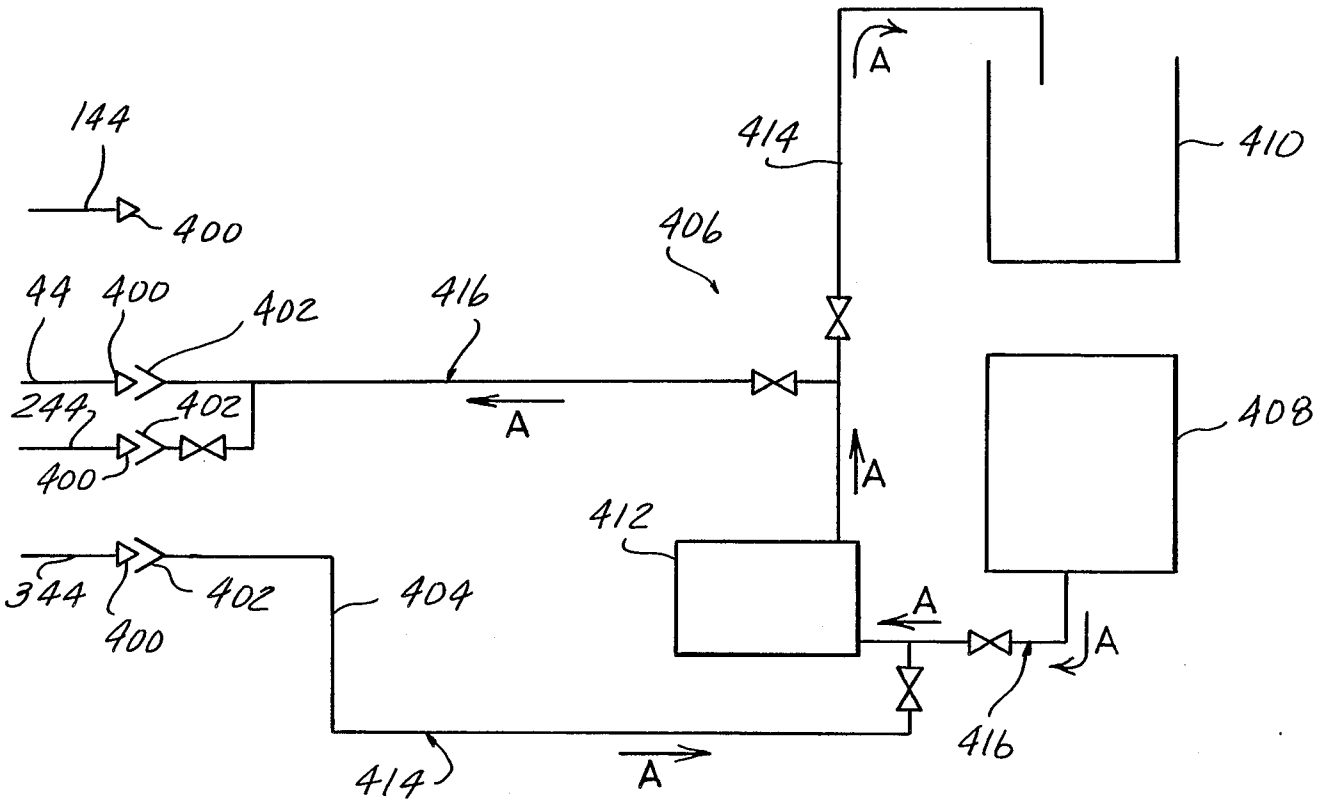
FIG. 7 is a schematic representation of an external recirculation pump device which can be employed in the present invention.

In all embodiments, the fill hose 44 (FIG. 2), or 144 (FIG. 4) connected to the connector 18 (FIG. 2), or 118 (FIG. 4) or hose connection port 262 (FIG. 5) may be equipped with a suitable quick connect coupling 400, as schematically shown in FIG. 7, adapted to be matingly received in a suitable coupling 402 on the pump fill line 416 of external pump device 406. It is also within the purview of the second embodiment, to have fill hose 144 permanently connected to both the oil fill adapter 110 and the external pump device 406. Where both a valve opening oil fill adapter 10 (FIG. 2), or 110 (FIG. 4) and a dipstick tube oil fill adapter 210 (FIG. 5) are employed on the same vehicle, these devices may be employed in tandem to decrease the total time necessary to accomplish oil filling. When employing an oil fill adapter such as those of the present invention to facilitate an oil change procedure, spent oil may be removed from the vehicular oil pan by conventional means if necessary. However, it is within the purview of this invention to facilitate and speed the removal of spent oil by utilizing a specially equipped drain opening adapter such as the drain opening adapter 300 shown in FIG. 6.

Drain opening adapter 300 is composed of a body member 302 having a central throughbore 306 extending therethrough and a branch throughbore 304 which is in fluid communication with central throughbore 306 and is angularly oriented thereto. Branch throughbore 304 may have an externally threaded male first end 308 adapted to matingly engage within the internally threaded female aperture 301 formed in the bottom of the oil pan 321.

In the alternative, an internally threaded end of branch throughbore 304 may be adapted to receive a portion of an externally threaded male connecting member therein. The connecting member may include a first exteriorly threaded region adapted to be threadingly received in the internally threaded end of branch throughbore 304 and a second exteriorly threaded region adapted to be threadingly received in the drain plug opening 301 of oil pan 321. To facilitate attachment of the drain opening adapter 300 in the drain plug opening 301, the connecting member may have a centrally positioned square or hexagonal shaped portion adapted to be engaged by known tools for turning the connecting member to threadingly engage with the aperture 301 of the oil pan 321 and branch throughbore 304 of the adapter 300. The connecting member, of course, would have a throughbore longitudinally extending therethrough to bring the oil pan interior into fluid communication with the branch throughbore 304 and central throughbore 306.

The central throughbore 306 of drain opening adapter 300 has first and second ends, 310 and 312 respectively. One end of the central throughbore is adapted to receive the drain plug 311. The other end of the central throughbore is adapted to receive hose connector 314. Preferably, the hose connector 314 is a push-on type hose connector adapted to sealingly engage an end section of hose 344 without requiring the use of hose clamps, as is commercially available and known in the hose connecting art. The hose or pump-out line 344 is attached to the drain opening adaptor 300 at the outlet of central throughbore 306.

As shown schematically in FIG. 7, the pump-out hose 344 may include a suitable quick connect coupling member 400 which can be releasably connected to a mating quick connect coupling member 402 located on the fluid hose 404 of external pump device 406. The external pump device 406 is in fluid communication with a suitable storage tank 408, for holding fresh motor oil and a reservoir for containing spent motor oil 410.

The external pump device 406 also has at least one suitable pump 412 capable of conveying the desired fluid to or from the engine. In general the pump 412 is one which is capable of producing sufficient pumping pressure to introduce the fresh motor oil in a safe and efficient manner. Additionally, the pump 412 or other pumps are capable of drawing spent fluid out of the engine utilizing suction or vacuum force. The external pump device 406 also includes spent fluid conveying means 414 connecting the pump 412 and the spent fluid tank 410 with the drain opening adapter 300 and hose 344. A fresh fluid conveying means 416 connects the pump 412, and the fresh fluid tank 408, with fill adapter 10 or 110 and/or 210 through hose fill line 44 or 144, and/or 244 respectively. Fluid conveying means 414 and/or 416 may include a quick connect coupling member 402. Direction of fluid flow within the conveying means is indicated by arrows A. Routing of flow direction can be obtained by the employment of suitable valves located in the various fluid conveying means.

THE PROCESS

The oil fill adapter 10, 110 and/or 210 and/or the drain opening adapter 300 can be employed in the oil change process which will now be discussed.

In the oil change process of the present invention, fill hose 44 or 144 and/or 244, and pump-out hose 344 are coupled to the external pump device 406 and the major portion of the spent oil is removed from the oil pan 321 by a positive removal force exerted on the spent oil by external pump device 406. The spent oil passes through a pump-out line such as pump-out line 404 and is ultimately conveyed to a suitable holding reservoir such as holding reservoir 410 until the spent oil can be recycled or disposed of in an environmentally sound manner.

An appropriate amount of fresh motor oil can be introduced into the engine through fill hose 44 or 144, and/or 244 and oil fill adapter 10 or 110, and/or 210 respectively. The amount of fresh oil introduced through the oil fill adapter 10 or 110, and/or 210 is the appropriate quantity for recirculation through the engine when it is running. The fresh motor oil is, preferably, introduced into the engine compartment at a pressure sufficient to efficiently fill the engine compartment without damaging the engine components. Where the valve cover oil fill adapter 10 or 110 is employed, it may be possible to induce a spraying pattern in the introduced oil to insure that some of the engine component surfaces are covered with lubricating oil. The pressure necessary to achieve this spraying pattern will vary with the type and configuration of the respective engine and the viscosity of the oil introduced. Pumping pressure during addition of the fresh oil is provided by the external pump device 406. If desired or required, the oil filter may be changed during the oil change process. This can occur at any time but would preferably occur after removal of the spent oil from the crankcase.

After the fresh oil has been added, the coupling members can be disconnected and the engine operated in the normal manner. The present invention provides a cleaner environment by the virtual elimination of oil vapors inhaled by the operator, a simplified, high speed oil change process and a method which reduces the time necessary to accomplish an oil change, and the mess associated therewith. This improves motor filter life and improves engine performance. Also this provides an easy and environmentally safe and clean means of collecting spent oil for the do-it-yourself oil change market which further reduces the energy trade deficit through recycling of the spent oil.

What is claimed is:

1. An adapter system for facilitating rapid, efficient and effortless oil change in an internal combustion engine having at least one engine oil inlet opening, the adapter system comprising at least one oil filler adapter insertable in the one engine oil inlet opening, said oil filler adapter comprising:

(a) a central oil conveying conduit having an inlet, an outlet and a connecting passage therebetween;

(b) a filling hose having a first end attached to said inlet and a second end having a quick connect coupling member attached thereto; said quick connect coupling member releasably attachable to a fill point on an external pump device; and (c) means for sealingly attaching said outlet of said central oil conveying body to the associated engine oil inlet opening.

2. The oil filler adapter of claim 1 wherein said oil conveying body comprises:

a cap portion containing said oil filler adapter outlet, said cap portion having a planar lid and an insert sleeve, said insert sleeve being integrally connected to said planar lid and extending perpendicularly outward therefrom, said planar lid having a first diameter greater than the associated engine oil inlet opening, said insert sleeve having a second diameter less than said diameter of said planar lid, said insert sleeve positionable in the associated engine oil inlet opening; and a connector attached to said cap portion, said connector containing said oil filler adapter inlet.

3. The oil filler adapter of claim 2 wherein said means for connecting said fill hose to said inlet comprises:

a hollow arm integrally connected with and extending outward from said connector, said filler hose attached thereto.

4. The oil filler adapter of claim 1 wherein said sealing means comprises a plug member having a pair of opposed parallel faces and a compressible tapered outer surface region therebetween, said parallel faces each having a centrally positioned aperture, said central oil conveying conduit extending therethrough; and means for movably maintaining said opposed parallel faces into compressible position relative to one another.

5. The oil filler adapter of claim 1 wherein the engine oil inlet opening is a dipstick tube and said oil conveying conduit comprises:

a hollow tubular shaft having a first outlet adapted to fit matingly with said dipstick tube, a second outlet opposed to said first outlet and a centrally located hose connection inlet port; and means for sealingly maintaining an associated dipstick in said second outlet.

6. The oil filler adapter of claim 5 wherein the means for sealingly attaching said oil conveying body to said dipstick tube comprises:

an attaching sleeve extending laterally outward from the second outlet, said attaching sleeve positionable in overlying contact with said dipstick tube;

a clamp encircling said sleeve; and an interiorly projecting retention collar annularly positioned in said hollow tubular shaft between said first outlet and said hose connection inlet port.

7. The oil filler adapter of claim 5 wherein said centrally located hose connection inlet port comprises:

a hollow arm projecting angularly outward from said hollow tubular shaft in fluid communication therewith; and means for attaching said fill hose to said hollow arm.

8. The oil filler adapter of claim 5 wherein said means for sealingly maintaining an associated dipstick in said second outlet comprises:

a removable plug sealingly positioned in said second outlet, said plug including an associated dipstick having an indicator blade projecting outward therefrom.

9. An adapter system for facilitating rapid efficient and effortless oil change in an internal combustion engine having an oil pan with a drain plug opening, the adapter system comprising a drain opening adapter in fluid communication with the drain plug opening of the oil pan, said drain opening adapter comprising:

(a) a body member having first, second and third ends with a fluid passage interconnecting each end;

(b) means for attaching said drain opening body member to the drain plug opening, said attaching means connecting the drain plug opening and said first end of said drain opening adapter;

(c) means for threadingly attaching an associated drain plug to said second end of said drain opening adapter;

(d) an oil conveying hose having a first end and a second end, said first end connected to said third end of said drain opening adapter; and (e) a quick connect coupling member attached to said oil conveying hose, said quick connect coupling member releasably attachable to a pump-out point on said external pump device.

10. The drain opening adapter of claim 9 wherein said means for attaching said body member to said drain plug opening is a hollow shaft having first and second ends, said first end having an exterior threaded surface matingly receivable in the drain plug opening and said second end includes means for connecting to said first end of said body member.

11. An adapter system for facilitating rapid, efficient and effortless oil change in an internal combustion engine having at least one engine oil inlet opening, and an engine oil pan having a drain plug opening, the adapter system comprising:

(I) at least one oil filler adapter insertable in the one engine oil inlet opening, said oil filler adapter comprising:

(a) a central oil conveying conduit having an inlet, an outlet and a connecting passage therebetween;

(b) a filling hose having a first end attached to said inlet and a second end having a quick connect coupling member attached thereto; said quick connect coupling member releasably attachable to a fill point on an external pump device; and (c) means for sealingly attaching said outlet of said central oil conveying body to the associated engine oil inlet opening; and (II) a drain opening adapter in fluid communication with the drain plug opening of the oil pan, said drain opening adapter comprising:

(a) a body member having first, second and third ends with a fluid passage interconnecting each end;

(b) means for attaching said drain opening body member to the drain plug opening, said attaching means connecting the drain plug opening and said first end of said drain opening adapter;

(c) means for threadingly attaching an associated drain plug to said second end of said drain opening adapter;

(d) an oil conveying hose having a first end and a second end, said first end connected to said third end of said drain opening adapter; and (e) a quick connect coupling member attached to said oil conveying hose, said quick connect coupling member releasably attachable to a pump-out point on said external pump device.

12. The drain opening adapter of claim 11 wherein said means for attaching said body member to said drain plug opening is a hollow shaft having first and second ends, said first end having an exterior threaded surface matingly receivable in the drain plug opening and said second end includes means for connecting said first end of said body member.

13. The oil filler adapter of claim 11 wherein said oil conveying body comprises:

a cap portion containing said oil filler adapter outlet, said cap portion having a planar lid and an insert sleeve, said insert sleeve being integrally connected to said planar lid and extending perpendicularly outward therefrom, said planar lid having a first diameter greater than the associated engine oil inlet opening, said insert sleeve having a second diameter less than said diameter of said planar lid, said insert sleeve positionable in the associated engine oil inlet opening; and a connector attached to said cap portion, said connector containing said oil filler adapter inlet.

14. The oil filler adapter of claim 13 wherein said means for connecting said fill hose to said inlet comprises:

a hollow arm integrally connected with and extending outward from said connector, said filler hose attached thereto.

15. The oil filler adapter of claim 11 wherein the engine oil inlet opening is a dipstick tube and said oil conveying body comprises:

a hollow tubular shaft having a first outlet adapter to fit matingly with said dipstick tube, a second outlet opposed to said first outlet and a centrally located hose connection inlet port; and means for sealingly maintaining an associated dipstick in said second outlet.

16. The oil filler adapter of claim 15 wherein the means for sealingly attaching said oil conveying body to said dipstick tube, said sealing means comprising:

an attaching sleeve extending laterally outward from the second outlet, said attaching sleeve positionable in overlying contact with said dipstick tube;

a clamp encircling said sleeve; and an interiorly projecting retention collar annularly positioned in said hollow tubular shaft between said first outlet and said hose connection inlet port.

17. The oil filler adapter of claim 15 wherein said centrally located hose connection inlet port comprises:

a hollow arm projecting angularly outward from said hollow tubular shaft in fluid communication therewith; and means for attaching said fill hose to said hollow arm.

18. The oil filler adapter of claim 15 wherein said means for sealingly maintaining an associated dipstick in said second outlet comprises:

a removable plug sealingly positioned in said second outlet, said plug integral with an indicator blade of said associated dipstick.

19. In an internal combustion engine having at least one engine oil inlet opening in fluid communication with an engine oil pan, and an oil pan having a drain plug opening, the improvement comprising an adapter system for facilitating rapid efficient and effortless oil change, the adapter system comprising:

(I) at least one oil filler adapter insertable in the one engine oil inlet opening, said oil filler adapter comprising:

(a) a central oil conveying conduit having an inlet, an outlet and a connecting passage therebetween;

(b) a filling hose having a first end attached to said inlet and a second end having a quick connect coupling member attached thereto; said quick connect coupling member releasably attachable to a fill point on an external pump device; and (c) means for sealingly attaching said outlet of said central oil conveying body to the associated engine oil inlet opening; and (II) a drain opening adapter in fluid communication with the drain plug opening of the oil pan, said drain opening adapter comprising:

(a) a body member having first, second and third ends with a fluid passage interconnecting each end;

(b) means for attaching said drain opening body member to the drain plug opening, said attaching means connecting the drain plug opening and said first end of said drain opening adapter;

(c) means for threadingly attaching an associated drain plug to said second end of said drain opening adapter;

(d) an oil conveying hose having a first end and a second end, said first end connected to said third end of said drain opening adapter; and (e) a quick connect coupling member attached to said oil conveying hose, said quick connect coupling member releasably attachable to a pump-out point on said external pump device.

20. The drain opening adapter of claim 19 wherein said means for attaching said body member to said drain plug opening is a hollow shaft having first and second ends, said first end having an exterior threaded surface matingly receivable in the drain plug opening and said second end includes means for connecting said first end of said body member.

21. The oil filler adapter of claim 19 wherein said oil conveying body comprises:

a cap portion containing said oil filler adapter outlet, said cap portion having a planar lid and an insert sleeve, said insert sleeve being integrally connected to said planar lid and extending perpendicularly outward therefrom, said planar lid having a first diameter greater than the associated engine oil inlet opening, said insert sleeve having a second diameter less than said diameter of said planar lid, said insert sleeve positionable in the associated engine oil inlet opening; and a connector attached to said cap portion, said connector containing said oil filler adapter inlet.

22. The oil filler adapter of claim 21 wherein said means for connecting said fill hose to said inlet comprises:

a hollow arm integrally connected with and extending outward from said connector, said filler hose attached thereto.

23. The oil filler adapter of claim 19 wherein the engine oil inlet opening is a dipstick tube and said oil conveying conduit comprises:

a hollow tubular shaft having a first outlet adapted to fit matingly with said dipstick tube, a second outlet opposed to said first outlet and a centrally located hose connection inlet port; and means for sealingly maintaining an associated dipstick in said second outlet.

24. The oil filler adapter of claim 23 wherein the means for sealingly attaching said oil conveying body to said dipstick tube, said sealingly means comprising:

an attaching sleeve extending laterally outward from the second outlet, said attaching sleeve positionable in overlying contact with said dipstick tube;

a clamp encircling said sleeve; and an interiorly projecting retention collar annularly positioned in said hollow tubular shaft between said first outlet and said hose connection inlet port.

25. The oil filler adapter of claim 23 wherein said centrally located hose connection inlet port comprises:

a hollow arm projecting angularly outward from said hollow tubular shaft in fluid communication therewith; and means for attaching said fill hose to said hollow arm.

26. The oil filler adapter of claim 23 wherein said means for sealingly maintaining an associated dipstick in said second outlet comprises:

a removable plug sealingly positioned in said second outlet, said plug integral with an indicator blade of said associated dipstick.

* * * * *